US010464124B2

(12) United States Patent
Enzinger et al.

(10) Patent No.: US 10,464,124 B2
(45) Date of Patent: Nov. 5, 2019

(54) STRAND GUIDING SYSTEM AND METHOD FOR THE CONFIGURATION OF SUCH A STRAND GUIDING SYSTEM

(71) Applicant: Primetals Technologies Austria GmbH, Linz (AT)

(72) Inventors: Christian Enzinger, Leonding (AT); Daniel Fuchshuber, Pucking (AT); Christian Gruber, Luftenberg (AT); Franz Josef Hoechtel, Lambach (AT); Robert Hornbachner, Aschach an der Steyr (AT); Wolfgang Kibler, Gallneukirchen (AT); Nicole Oberschmidleitner, Linz (AT); Michael Starrermair, Wolfern (AT); Helmut Wahl, Luftenberg/Donau (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 256 days.

(21) Appl. No.: 15/522,856

(22) PCT Filed: Oct. 27, 2015

(86) PCT No.: PCT/EP2015/074831
§ 371 (c)(1),
(2) Date: Apr. 28, 2017

(87) PCT Pub. No.: WO2016/066625
PCT Pub. Date: May 6, 2016

(65) Prior Publication Data

US 2017/0326625 A1 Nov. 16, 2017

(30) Foreign Application Priority Data

Oct. 28, 2014 (AT) ..... A50775/2014

(51) Int. Cl.
*B22D 11/128* (2006.01)
*B22D 11/20* (2006.01)

(52) U.S. Cl.
CPC ..... *B22D 11/128* (2013.01); *B22D 11/20* (2013.01)

(58) Field of Classification Search
CPC ..... B22D 11/128; B22D 11/20
(Continued)

(56) References Cited

U.S. PATENT DOCUMENTS 5,727,127 A * 3/1998 Schulze Horn et al. ..... B22D 11/16 706/47
5,941,299 A * 8/1999 Striuli et al. ..... B22D 11/1206 164/452
2008/0147349 A1 6/2008 Wilmes et al. ..... 702/150

FOREIGN PATENT DOCUMENTS

EP 1 475 169 A1 11/2004
EP 1 807 230 A1 7/2007
(Continued)

OTHER PUBLICATIONS

International Search Report dated Jan. 14, 2016 in corresponding PCT International Application No. PCT/EP2015/074831.
(Continued)

*Primary Examiner* — Kevin P Kerns
(74) *Attorney, Agent, or Firm* — Ostrolenk Faber LLP

(57) ABSTRACT

A method and a system for configuring a strand guiding system (8, 8*a*, 8*b*) of a continuous casting machine (2) and such a strand guiding system (8, 8*a*, 8*b*). A strand guiding segment (10*g-r*) guides a metal strand in the strand guiding system (8, 8*a*, 8*b*). The strand guiding system (8, 8*a*, 8*b*) has a plurality of strand guiding segments (10*g-r*) and respective control units (22*g-r*), wherein each control unit (22*g-r*) identifies its strand guiding segment (10*g-r*), and each
(Continued)

control unit (22*g-r*) automatically depends on the strand guiding segments (10*g-r*) identified by the control unit (22*g-r*). The strand guiding system (8, 8*a*, 8*b*) and the strand guiding segment (10*g-r*) are prepared for the performance of the method herein disclosed.

17 Claims, 6 Drawing Sheets

(58) Field of Classification Search
USPC ..... 164/454, 484, 413, 442, 448
See application file for complete search history.

(56) References Cited

FOREIGN PATENT DOCUMENTS

| | | | |
|---|---|---|---|
| EP | 1 807 230 | B1 | 6/2008 |
| WO | WO 03/051558 | A2 | 6/2003 |
| WO | WO 2006/050868 | A1 | 5/2006 |

OTHER PUBLICATIONS

Written Opinion dated Jan. 14, 2016 in corresponding PCT International Application No. PCT/EP2015/074831.
Austrian Office Action dated Sep. 7, 2015 in corresponding Austrian Patent Application No. 50775/2014.
Austrian Office Action dated Oct. 3, 2016 in corresponding Austrian Patent Application No. 50775/2014.

* cited by examiner

STRAND GUIDING SYSTEM AND METHOD FOR THE CONFIGURATION OF SUCH A STRAND GUIDING SYSTEM

CROSS-REFERENCE TO RELATED APPLICATIONS

The present application is a 35 U.S.C. §§ 371 national phase conversion of PCT/EP2015/074831, filed Oct. 27, 2015, which claims priority of Austrian Patent Application No. A50775/2014, filed Oct. 28, 2014, the contents of which are incorporated by reference herein. The PCT International Application was published in the German language.

TECHNICAL FIELD

The invention relates to a method for configuring a strand guiding system of a continuous casting machine, and to a strand guiding system having a plurality of strand guiding segments.

TECHNICAL BACKGROUND

In continuous casting of metals, a metallic molten mass is supplied to a cooled mold, is solidified in the mold, at least in the edge zone of the molded mass, and usually supplied continuously while already in the form of a strand, from the mold to a strand guiding system of the continuous casting machine which is downstream from the mold, and is conveyed through the strand guiding system.

The strand is guided, supported and subjected to further cooling by the strand guiding system. For this purpose, the strand guiding system usually has a plurality of strand guiding segments, disposed in succession along a strand conveying means. Usually, these strand guiding segments can be demounted or replaced individually.

Each strand guiding segment usually has a plurality of strand guiding rollers, between which the strand is guided. At least some of these strand guiding rollers can usually be set against the strand in multiples or singly, and depending on the structural type of the strand guiding segment can be controlled, by an open-loop or closed-loop control, by means of an open-loop or closed-loop control means.

In particular, for the purpose of maintenance or servicing, it is usual for a strand guiding segment to be removed from the strand guiding system and, for example, to be replaced by another strand guiding segment.

Besides mechanical demounting and mounting of the strand guiding segment, this may necessitate, in particular, configuring, in the widest sense, establishment, adaptation of operating parameters of the strand guiding system, in particular configuring the open-loop or closed-loop control means of the strand guiding system.

A strand guiding system, having a plurality of successive strand guiding segments for a continuous casting machine is known from EP 1 807 230 B1. This publication makes no disclosure concerning configuring the strand guiding system, or its configuration.

SUMMARY OF THE INVENTION

It is an object of the invention to enable a strand guiding system to be configured in an advantageous manner.

This object is achieved by a method for configuring a strand guiding system, and by a strand guiding system, of the type stated at the outset hereof.

The strand guiding system has a plurality of strand guiding segments and control units, with one control unit assigned to each strand guiding segment.

Each control unit identifies a strand guiding segment assigned to it by use of a segment-specific item of information, which is software coded and/or hardware coded.

Each control unit is configured substantially automatically depending on the strand guiding segment identified by it, by setting of operating parameters and/or by selection of a computer-readable program code.

"Assigned" or "assign" in this case may be understood to mean any establishment of a direct or indirect signal connection or information connection between a strand guiding segment and a control unit. Respectively one control unit may be assigned to each strand guiding segment, and respectively one strand guiding segment respectively may be assigned to each control unit, such that an unambiguous assignment is achieved.

The respective strand guiding segment can be controlled by the control unit assigned to it, by means of an open-loop or closed-loop control signal, or by means of open-loop or closed-loop control signals (for example, as a set of open-loop or closed-loop signals).

In such a manner and depending on the structural type of the respective strand guiding segment, a plurality of strand guiding rollers or a single strand guiding roller of the respective strand guiding segment can be set against the strand under open-loop or closed-loop control. It is advantageous if a setting force and/or a setting position of the strand guiding roller, or strand guiding rollers, is controlled by open-loop or closed-loop control.

Each control unit may have a plurality of closed-loop control elements, in particular a plurality of so-called axis controllers, wherein an individually settable strand guiding roller of the strand guiding segment assigned to the control unit is assignable to each closed-loop control element.

Within the meaning of the present invention, a control unit can identify a strand guiding segment if it identifies, or locates, the strand guiding segment, in particular its structural type, on the basis of a technical feature, a property, an information signal, an item of segment-specific information, an identifier or the like.

A configuration may be characterized as a particular adaptation of a computer-readable program code of a computer to an existing system and/or to given operating boundary conditions, and the system itself in its composition and/or setting. Following installation and/or initial setting, the term may also include selectable pre-settings, or a selection of operating parameters.

"Configure", and "configured" means setting, inputting, loading, or the like of operating parameters, selection of operating parameters from a set of preset available operating parameters, selection of a computer-readable program code or a software, selection of parameters of a computer-readable program code, or of a software, or the like.

The strand guiding system comprises a plurality of strand guiding segments for guiding a metallic strand. Each strand guiding has a software coding and/or a hardware coding for identifying it, and a plurality of control units, wherein a respective one of the control units is assigned to each strand guiding segment for the purpose of controlling the strand guiding segment by means of an open-loop or closed-loop control signal, or by means of open-loop or closed-loop control signals (for example, as a set of open-loop or closed-loop control signals). Each control unit is prepared for identification of the strand guiding segment respectively assigned to the segment by use of the software coding and/or hardware coding of the respective strand guiding segment, and each control unit has a configuration that can be adapted substantially automatically, dependent on the identified strand guiding segment, by setting operating parameters and/or by selecting a computer-readable program code.

A software coding may be understood to mean a unique data-based or signal-based identifier of the strand guiding segment, in particular, having at least the structural type of the strand guiding segment. This software identifier may be such that it can be read out, for example, from a data storage that is disposed, in particular, on the strand guiding segment, and can be transmitted to the control unit.

A hardware coding may be understood to mean a unique identifier that is inherent to a mechanical element of the strand guiding segment, in particular, having at least the structural type of the strand guiding segment and in particular to a property of this element. This hardware coding may be constituted, for example, by a segment-specific, optically perceivable feature of the strand guiding segment.

A first of the plurality of strand guiding segments may be a strand guiding segment having a plurality of individually settable strand guiding rollers disposed in succession in a strand conveying direction, wherein each of the individually settable strand guiding rollers can be controlled separately by open-loop or closed-loop control. The strand guiding segment in the aforementioned embodiment may require a configuration of the control unit assigned to it, which configuration is performed or adapted in a first manner.

A further one of the plurality of strand guiding segments may require a configuration of the control unit assigned to it, which configuration is performed or adapted in a further, different manner.

A configuration may be understood to mean specifically set or input operating parameters, a loaded or executed computer-readable program, or a software, specifically set, or input parameters of a computer-readable program code, or a software, or the like.

Advantageously, the control units, in particular the control units that are of substantially the same structural type, have a substantially uniform basic setting, or a generic configuration, that in each case can be adapted, depending on the strand guiding segment respectively assigned to the control unit, in a first and at least one further, different, manner.

Within the meaning of the present invention, "can be configured/adapted substantially automatically" may mean that the configuration/adaptation is effected with the avoidance of manual interventions, in particular at least predominantly in a self-acting manner, preferably entirely in a self-acting manner. For example, configuring following a previous clearance handling and/or acknowledgement handling by an operator of the strand guiding system, in particular at an operator interface of the strand guiding system, may be effected in a self-acting manner, i.e. without further action by the operator manner.

In simple terms, the invention is based on the consideration that the strand guiding system, in particular the control units, or the open-loop or closed-loop control means of the strand guiding segments, require elaborate configuration in the widest sense, require adaptation following a replacement of strand guiding segments, in particular of differing structural types, and therefore requiring differing types of control, wherein the replacement is necessitated by maintenance or servicing.

By assigning respectively one control unit to respectively one strand guiding segment, and by the modular structure thereby achieved, the invention creates a condition for configuring the strand guiding system in a manner that is favorable in respect of work required.

Owing to use of control units provided with a configuration that can be adapted depending on the identified strand guiding segment, the invention allows simplified maintenance and/or following mounting or removal or replacement of a strand guiding segment, costly and time-consuming manual replacement of the control unit assigned to this strand guiding segment can be avoided.

In addition, owing to the substantially automatic configuring of the strand guiding system or of the control units, the invention enables savings to be made in deployments of personnel. Furthermore, errors in the configuration of the strand guiding system that result from human error can be avoided in this way.

The invention and the developments described may be realized both in software and in hardware, for example by use of a special electrical circuit.

Further, it is possible for the invention, of a described development, to be realized by a non-volatile computer-readable storage medium, stored on which there is a computer program that executes the invention or the development.

The invention and/or any described development may also be realized by a computer program product that has a non-volatile storage medium on which there is stored a computer program that executes the invention and/or the development.

Within the meaning of the present invention, an item of information may be segment-specific if the item of information enables at least the structural type of a strand guiding segment to be unambiguously identified. The segment-specific item of information may be an identification number and/or taken from a technical feature, a segment-specific property, an information signal, or the like.

Advantageously, the segment-specific item of information is transmitted to the control unit via a communication channel established between the strand guiding segment and the control unit assigned thereto, for example a field bus connection, a LAN or WLAN connection, or the like.

"Software coded" may be understood to mean that the segment-specific item of information is held or stored in a readable or determinable manner, in particular on the strand guiding segment, by use of a computer-readable program code. Advantageously, the software coding is stored in an over-writable and/or erasable manner, such that particularly simple adaptation of the segment-specific item of information can be achieved.

"Hardware coded" may be understood to mean that the segment-specific item of information is inherent to a mechanical element of the strand guiding segment, in particular to the properties of the element. In this way, it is possible to avoid the use of separate data storage media for storing the segment-specific item of information as a data item, and to avoid any data errors associated therewith.

According to a preferred development, the software coding is constituted by a data item that can be stored in a storage unit of the strand guiding segment.

The storage unit is expediently a data storage unit, for example an RFID (radio frequency identification) storage element, a RAM (random access memory) storage module, or the like. There is a wealth of practical experience in the use of RFID storage elements, known per se. By use of an RFID storage element and a corresponding read unit which can acquire the segment-specific item of information and transmit it, via an information channel, to the control unit it is possible to achieve contactless identification of the strand guiding segment. RAM storage modules can be obtained, in a great variety of embodiments and specifications, at a very low cost. In this way, the software coded segment-specific item of information can be stored in a particularly inexpensive manner.

Other items of information, or data, such as, in particular, segment-specific data, for example geometry data, such as roller diameter, and/or data relating to the displacement measuring system, such as mechanical data, may also be stored, or have been stored, in the storage unit, in particular in the data storage unit. These items of information, or data, may be used to check the strand guiding segment.

In an advantageous development, the hardware coding is constituted by a segment-specific plug connection of the strand guiding segment. Advantageously, the plug connection is a plug connection for information-based or signal-based connection of the strand guiding segment to the control unit assigned thereto. The segment-specific plug connection may be a plug connection for connecting the strand guiding segment to a bus network, to a LAN network, to a fiber-optic network, or the like.

A plug connection may be segment-specific if it is assigned to a specific structural type of strand guiding segment and/or to a specific strand guiding segment. Advantageously, a strand guiding segment in a first design may have a plug connection coded in a first manner, for example a 4-pole plug connection, and a strand guiding segment in a further design may have a plug connection coded in another manner, for example a 6-pole plug connection. Coded plug connections are available in a multiplicity of differing embodiments. In this way, the hardware coding can be constituted in a manner that is particularly favorable in respect of resource requirement, since a plug connection for connecting the strand guiding segment to the control unit assigned thereto may be necessary in any case, for transmitting open-loop or closed-loop control signals.

Also, according to an advantageous embodiment, the control units may be realized so as to be logically and/or physically separate.

In an advantageous embodiment, control units that are substantially the same are assigned to strand guiding segments of differing structural types. Such an assignment of control units that are substantially the same i.e. control units of the same structural type and/or having the same basic configurations that can be adapted in dependence on the respectively identified strand guiding segment makes it possible to achieve a high proportion of component homogeneity. In this way, in particular, maintenance of the strand guiding segment and storage of replacement parts can be simplified, and expenditure can be saved.

It is advantageous if a main control unit assigned to the control units is configured substantially automatically in dependence on the identified strand guiding segment by setting of operating parameters and/or by selection of a computer-readable program code. The main control unit may be a means, of the same order or of a higher order than the plurality of control units, which is prepared to control the control units, for example by means of a setpoint value signal. It is advantageous if the segment-specific items of information of the identified strand guiding segments are transmitted indirectly, for example from the control units assigned to the strand guiding segments, to the main control unit.

Moreover, it is advantageous if an operator interface of the strand guiding segment is configured substantially automatically in dependence on the identified strand guiding segments.

Further, it is advantageous if a simulation model, on which open-loop control or closed-loop control of the strand guiding system is based, is configured substantially automatically for the purpose of determining open-loop or closed-loop control signals in dependence on the identified strand guiding segments. The simulation model may be realized as computer-readable program code on a processor unit of the main control unit.

Advantageously, setpoint values for open-loop control or closed-loop control of the setting positions and/or setting forces of the settable strand guiding rollers are determined by use of the simulation model, and transmitted to the control units. In a further step, the control unit, by use of the respectively transmitted setpoint value, in each case determines a manipulated value for the setting position and/or setting force. In a further step, the strand guiding segment assigned to the respective control unit is controlled, by use of the determined manipulated value, by means of an open-loop or closed-loop control signal, for the purpose of influencing the setting position and/or setting force of the settable strand guiding roller.

Moreover, it is advantageous if the method is used to configure the strand guiding segment after demounting and/or mounting of a strand guiding segment from or into the strand guiding system. In this way, set-up time can be reduced, and costs saved. In particular, if strand guiding segments of differing structural types, requiring differing types of control by open-loop or closed-loop control signals, are interchanged, this use of the method enables the strand guiding system to be configured in a particularly advantageous manner, since it is favorable in respect of resource requirement, avoids error and saves time.

In an advantageous design, the strand guiding segments each have a storage unit, in particular an RFID storage element and/or a RAM storage module, on which the software coding can be stored.

In a further advantageous embodiment, the hardware coding is constituted by a mechanical element, in particular by a segment-specific plug connection.

In a further embodiment, the control units each have a plurality of closed-loop control elements, wherein each closed-loop control element is respectively assigned to a strand guiding roller of the strand guiding segment assigned to the respective control unit, which strand guiding roller can be set individually against the strand.

A closed-loop control element may be realized in software and/or in hardware. The closed-loop control element may be prepared, by use of a known closed-loop control law, a setpoint value and an actual value of a controlled variable, to determine a manipulated value, or a closed-loop control signal, for influencing the controlled variable. The controlled variable may be a setting position and/or a setting force of a settable strand guiding roller.

Advantageously, respectively one closed-loop control element of the control unit is respectively assigned to a strand guiding roller of the strand guiding segment assigned to the control unit, such that a particularly refined and/or high-resolution closed-loop control can be achieved. It is also conceivable and advantageous for a closed-loop control element to be assigned to a plurality of strand guiding rollers, for example two, and to be prepared to control the latter. In this way the number of necessary closed-loop control elements can be reduced, and resource requirement can be avoided.

A roller unit may be constituted by respectively one strand guiding roller that can be set individually on the strand, an adjustment means for setting this strand guiding roller, for example a hydraulic cylinder. Advantageously, the roller units are prepared for individual demounting from the strand guiding segment and/or mounting into the strand guiding segment, and for individual connection to the control unit assigned to the strand guiding segment.

Advantageously, each roller unit is respectively connected, via a data connection or signal connection, to the closed-loop control element assigned thereto. The individual data connections or signal connections of the roller units of a strand guiding segment may be combined to form an aggregate connection. In this way, the strand guiding segment can be cable-connected in a manner that is favorable in respect of resource requirement. The data connection or signal connection may be a field-bus connection.

Advantageously, each roller element has a storage unit, on which an item of information specific to the roller unit, and/or a coded plug connection specific to the roller unit, can be stored. In this way, a condition for identification of the roller unit by the control unit can be achieved by simple means.

It is conceivable and advantageous for the control unit to be prepared to identify a roller unit of the strand guiding segment assigned thereto, and to have a configuration that is prepared for substantially automatic adaptation in dependence on the identified roller unit. In this way, it is possible to reduce set-up time for mounting and demounting a roller unit, and to avoid any operator errors in the configuration of the control unit.

In a development, the strand guiding system has a main control unit, which is assigned to the control units and which is prepared to control the control units by means of a respective setpoint value signal for forming open-loop or closed-loop control signals. In this way, it is possible to reduce set-up time, avoid any operator errors in the configuration of the main control unit. It is advantageous if the main control unit is connected to the control units via a network connection. In this way, a condition is created, in a simple manner, for the connection of any peripheral devices.

In an advantageous design, the main control unit is prepared to identify the strand guiding segments indirectly assigned thereto.

Advantageously, the main control unit has a configuration that can be adapted substantially automatically, in dependence on the identified strand guiding segments, by setting of operating parameters and/or by selection of a computer-readable program code.

In a preferred embodiment, the strand guiding system has an operator interface for operation of the strand guiding system. To enable good accessibility for combined servicing and/or operation, it is advantageous if the operator interface and the control units are immovably disposed in direct proximity to one another, for example in a common cabinet.

Advantageously, the operator interface has a configuration that can be adapted substantially automatically in dependence on the identified strand guiding segments.

It is advantageous if the strand guiding system has a simulation model, on which open-loop control or closed-loop control of the strand guiding system is based, for determining open-loop or closed-loop control signals.

Advantageously, the simulation model has a configuration that can be adapted substantially automatically in dependence on the identified strand guiding segments.

The description given hitherto of advantageous designs of the invention contains numerous features, in some cases multiply combined. However, these features may also expediently be considered individually and combined to create appropriate, further combinations.

In particular, these features can each be combined individually and in any appropriate combination with the method and/or strand guiding system and/or strand guiding segment according to the invention.

The properties, features and advantages of this invention that are described above, and the manner in which these are achieved, are rendered clearer and more readily comprehensible in the context of the following description of the exemplary embodiments, which are explained in greater detail in the context of the drawings.

The exemplary embodiments serve to explain the invention, and do not limit the invention to the combinations and features specified therein, including in respect of functional features.

DESCRIPTION OF EMBODIMENTS

Figure 1:
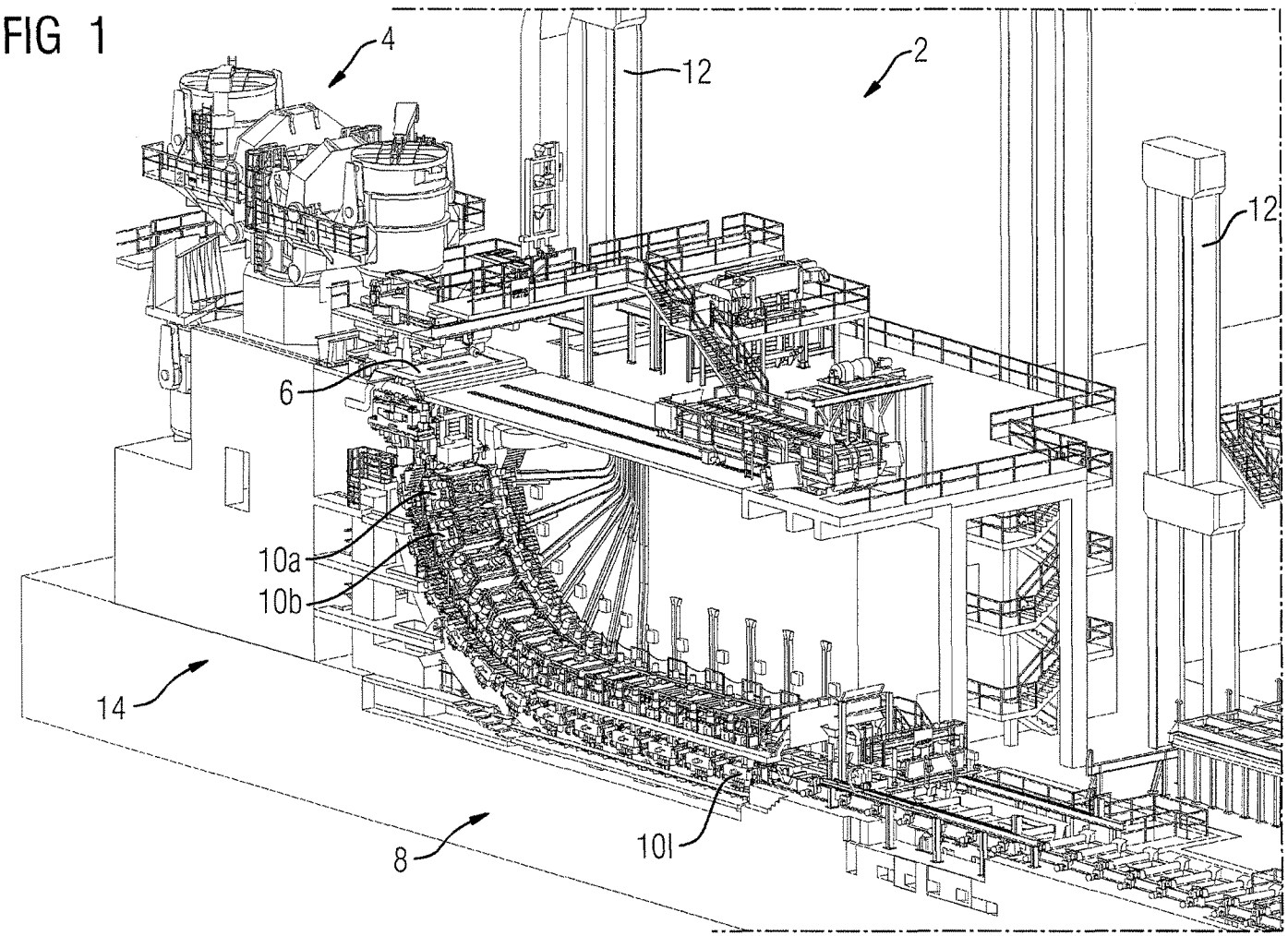
FIG. 1 is a schematic representation of a continuous casting machine, with a strand guiding system that has a plurality of strand guiding segments.

Features that are the same, but that may have slight differences, for example in an amount or a number value, in a dimension, a position and/or a function or the like, are denoted by the same reference numeral and a reference letter, or a different reference letter. If only the reference numeral is mentioned, without a reference letter, this relates to all the corresponding components of all exemplary embodiments.

FIG. 1 shows a schematic representation of a continuous casting machine 2 for producing a metallic strand. The continuous casting machine 2 has a ladle turret 4, a mold 6, and a strand guiding system 8 having a plurality of strand guiding segments 10*a* to 10*l*.

The continuous casting machine 2 is located in a hall, which is supported, with respect to a foundation, by means of a hall framework having a plurality of steel girders 12. The continuous casting machine 2 is supported on a supporting structure 14.

For the purpose of producing a metallic strand, liquid steel is supplied to the mold 6 via the ladle turret 4. In the mold 6, the liquid steel is brought to solidification, at least in a lateral edge zone, supplied continuously and already in the form of a partly solidified strand, from the mold 6 to the strand guiding system 8 of the continuous casting machine 2, and is conveyed through the latter.

The strand is guided, supported and subjected to further cooling by the strand guiding system 8. For this purpose, the strand guiding system 8 has a plurality of strand guiding segments 10*a* to 10*l*.

Figure 2:
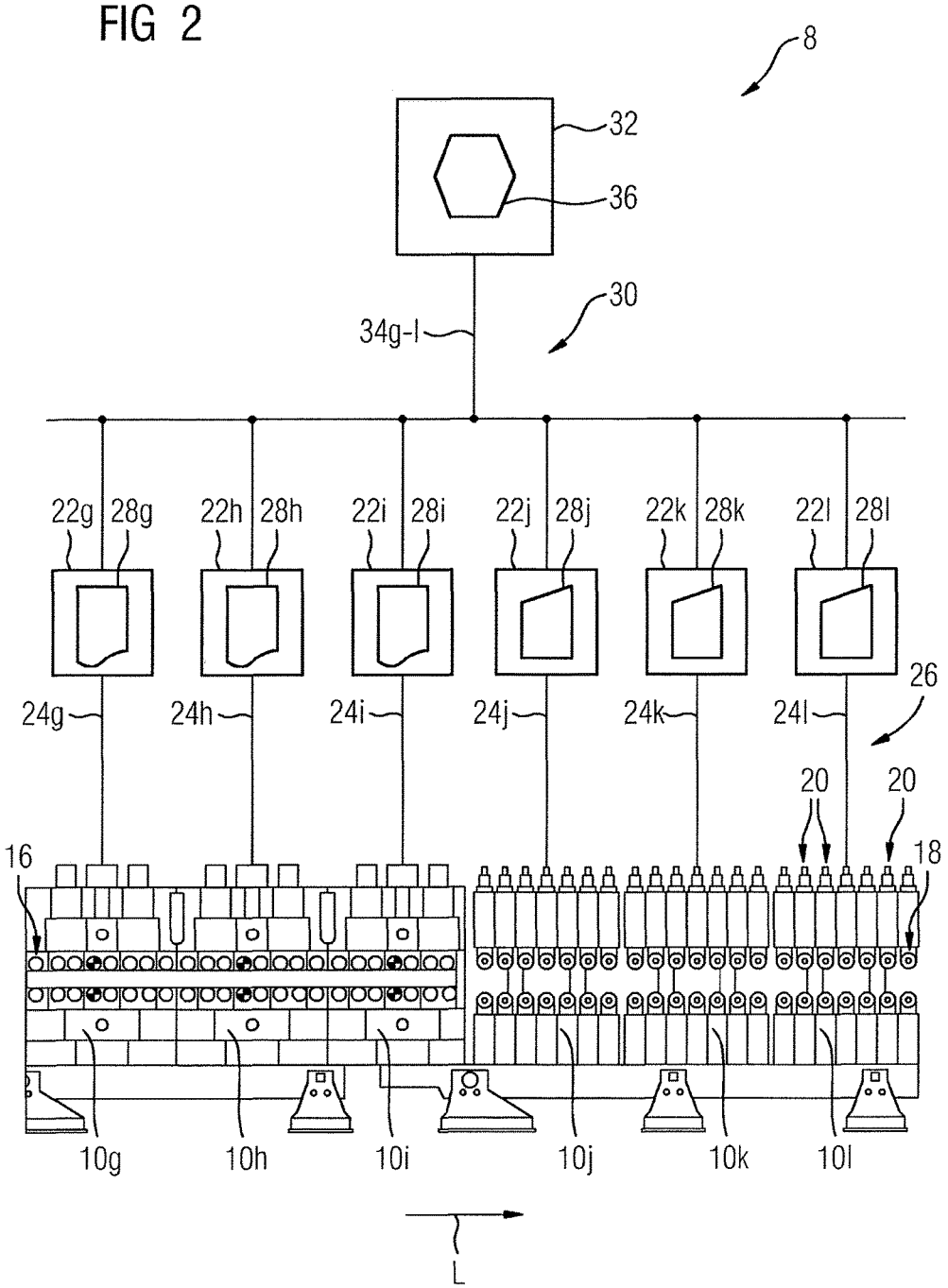
FIG. 2 is a schematic illustration of a portion of the strand guiding system from FIG. 1, with control units and a main control unit.

FIG. 2 shows a schematic illustration of a portion of the strand guiding system 8 from FIG. 1, with only the strand guiding segments 10*g* to 10*l* being represented in FIG. 2.

The strand guiding segments 10*g*, 10*h* and 10*i* are realized as so-called 4-axis segments, having strand guiding rollers 16 that can each be set against the strand in multiples. The strand guiding segments 10*j*, 10*k* and 10*l* are realized in a cassette design, having strand guiding rollers 18 that can each be set singly against the strand. Each of the strand guiding segments 10*j* to 10*l* respectively has a plurality of roller units 20, more precisely seven, which are structurally substantially the same and which are disposed in succession, in the manner of a cassette, in a strand longitudinal direction L.

Assigned to each of the strand guiding segments 10*g* to 10*l* respectively is a control unit 22*g* to 22*l* for controlling the respective strand guiding segment 10*g* to 10*l* by means of a respective open-loop or closed-loop control signal 24*g* to 24*l*, or open-loop or closed-loop control signals 24*g* to 24*l*.

The control units 22*g-r* are connected to the strand guiding segment 10*g* to 10*l* assigned thereto via a field bus 26, and are realized substantially with identical hardware, i.e. are structurally the same.

The control units 22*g-r* are prepared to identify the strand guiding segment 10*a-r* respectively assigned thereto by use of a segment-specific coding, here, specifically, a coding that indicates the structural type of the respective strand guiding segment 10*a-r*. In addition, the control units 22*g-r* each have a configuration 28*g-r* that can be adapted substantially automatically to strand guiding segments of differing types, more precisely to differing structural types of strand guiding segment, for example to the open-loop or closed-loop control specifications of 4-axis segments and/or cassette-type segments.

In the present case, the control units 22*g* to 22*l* respectively have a configuration 28*g* to 28*l* that is adapted substantially automatically in dependence on the respectively identified strand guiding segment 10*g* to 10*l*.

The configurations 28*g* to 28*l* in the present exemplary embodiment are to be understood to be, respectively, specifically set operating parameters of the control units 22*g* to 22*l*, and specific computer-readable programs, or software, that are executed on the control units.

The configurations 28*g*, 28*h* and 28*i* of the control units 22*g*, 22*h* and 22*i*, respectively, are adapted to the segment structural type, i.e. to the structural type, or to the type of control that is required by the structural type of the strand guiding segments 10*g*, 10*h* and 10*i*. The configurations 28*j*, 28*k* and 28*l* of the control units 22*j*, 22*k* and 22*l*, respectively, on the other hand, are adapted to the segment type, i.e. the structural type, of the strand guiding segments 10*j*, 10*k* and 10*l*, and differ from the configurations 28*g* to 28*i*.

Such an assignment of control units 22*g-r* that are substantially the same i.e. control units of the same structural type, having configurations 28*g-r* that can be adapted in dependence on the respectively identified strand guiding segment 10 makes it possible, in particular, to achieve a high proportion of component homogeneity within the strand guiding system 8.

The control units 22*g-r* are connected to a main control unit 32 via a network connection 30. The main control unit 32 is assigned to the control units 22*g-r*, and is prepared to control the latter by means of a respective setpoint value signal 34*g* to 34*l* for forming open-loop or closed-loop control signals 24. In addition, the main control unit 32 has a configuration 36. The main control unit 32 is prepared to identify the strand guiding segments 10 indirectly assigned thereto. The configuration 36 can be adapted substantially automatically in dependence on the identified strand guiding segments 10-*r*.

For the purpose of configuring the strand guiding system 8, each control unit 22*g-r* identifies the strand guiding segment 10 respectively assigned thereto, and each control unit 22*g-r* is configured substantially automatically in dependence on the strand guiding segment 22 identified by it. This means that the respective operating parameters and software settings of the control units 22*g-r* are adapted in such a manner, in dependence on the respectively identified strand guiding segment 10*a-r*, that the respective strand guiding segment 10*a-r* can be controlled in a manner appropriate to the structural type.

In the present exemplary embodiment, the identification is effected by means of respectively one segment-specific item of information that is transmitted, via the field bus 26, from each strand guiding segment 10*a-r* to the control units 22*g-r* respectively assigned thereto. These items of information are transmitted to the main control units 22*g-r* via the network connection 30. The configuration 36 of the main control unit is adapted substantially automatically in dependence on these items of information, or in dependence on the identified strand guiding segments 10*a-r*. Alternatively, the configuration 36 of the main control unit 32 may also be adapted to the configurations 28*g* to 28*l* of the control units 22*g* to 22*l* in this way, the control units 22*g-r* can be controlled by means of signals and/or supplied with data in a required manner which may correspond to an indirect adaptation of the configuration 36 to the identified strand guiding segments 10*a-r*.

The descriptions of exemplary embodiments that follow are generally limited substantially to the differences in relation to the exemplary embodiments from FIG. 1 and FIG. 2, to which reference is made with respect to features and functions that remain the same. Components that remain substantially the same are basically denoted by the same references, and features that are not mentioned are included in the following exemplary embodiments without being described over again.

Figure 3:
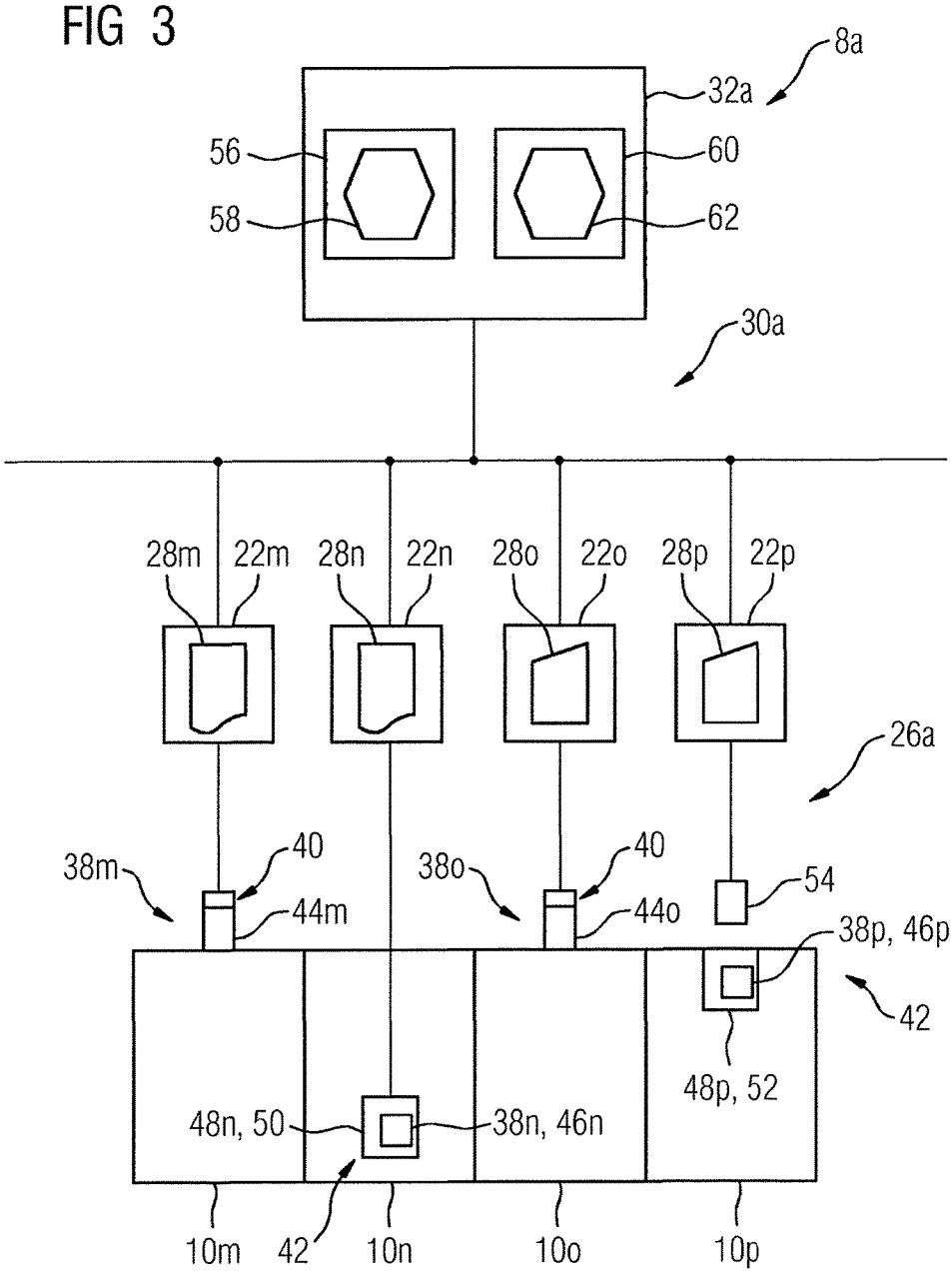
FIG. 3 is a schematic illustration of a further strand guiding system, with strand guiding segments that have variously coded segment-specific items of information.

FIG. 3 shows a schematic illustration of a further strand guiding system 8*a*, having strand guiding segments 10*m* to 10*p*, control units 22*m* to 22*p*, and a main control unit 32*a*. Via a field bus 26*a*, the strand guiding segments 10*m* to 10*p* are connected, by information or data connection means, to the control units 22*m* to 22*p* assigned thereto. The control units 22*m* to 22*p* are connected to the main control unit 32*a* via a network connection 30*a*.

The strand guiding segments 10*m* to 10*p* each have a segment-specific item of information 38*m* to 38*p* for identification thereof by the control units 22*g-r* assigned thereto, or by the main control unit 32*a*. The segment-specific items of information 38*m-r* are coded, at least partly, in differing ways.

The strand guiding segments 10*m* and 10*o* each have a hardware coding 40, and the strand guiding segments 10*n* and 10*p* each have a software coding 42.

The hardware codings 40 are each constituted by segment-specific plug connections 44*m* and 44*o*, respectively. The segment-specific plug connections 44*m* and 44*o* are plug connections for connecting the strand guiding segments 10*m* and 10*o*, respectively, to the field bus 26*a*. The plug connections 44*m* and 44*o* are segment-specific in the sense that they are assigned to the respectively specific structural type of the strand guiding segment 10*m* and 10*o*, respectively. In the present exemplary embodiment, the segment-specific plug connection 44*m* is a 4-pole plug connection, the plug connection 44*o* being a 6-pole plug connection.

The software codings 42 are each constituted by a data item 46*n* and 46*p*, respectively, in a storage unit 48*n* and 48*p*, respectively, of the strand guiding segment 10*n* and 10*p*, respectively.

The storage unit 48*n* is a RAM storage module 50, from which the segment-specific items of information 38*n*, or the segment-specific data item 46*n*, can be read out and transmitted, via the field bus 26*a*, to the control unit 22*n*.

The storage unit 48*p* is an RFID storage element 52, from which the segment-specific item of information 38*p* can be read out contactlessly by use of a read unit 54 and transmitted, via the field bus 26*a*, to the control unit 22*p*.

The configuring of the strand guiding system 8*a* is effected in dependence on the segment-specific items of information 38*m* to 38*p* as follows:

The strand guiding segment 10*m* has been or is connected, by means of the segment-specific plug connection 44*m*, via the field bus 26*a*, to the control unit 22*m* assigned thereto. The control unit 22*m* identifies the structural type of the strand guiding segment 10*m* on the basis of the segment-specific plug connection 44*m* used, and is configured, in dependence on the strand guiding segment 10*m*, or the structural type thereof, in such a manner that a configuration 28*m* adapted to the structural type of the strand guiding segment 10*m* is loaded, or established.

In addition, the strand guiding segment 10*o* has been or is connected, by means of the segment specific plug connection 44*o* which differs structurally from the plug connection 44*m* to the control unit 22*o* assigned thereto, via the field bus 26*a*. The control unit 22*o* identifies the structural type of the strand guiding segment 10*o* which differs from that of the strand guiding segment 10*m* on the basis of the segment-specific plug connection 44*o* used, and is configured, in dependence on the strand guiding segment 10*o*, or the structural type thereof, in such a manner that a configuration 28*o* adapted to the structural type of the strand guiding segment 10*m* is loaded, or established.

Furthermore, the segment-specific data item 46*n* is read out from the storage unit 48*n*, i.e. the RAM storage module 50, of the strand guiding segment 10*n*, and transmitted to the control unit 22*n* via the field bus 26*a*. The control unit 22*n* identifies the strand guiding segment 10*n*, or the structural type thereof, by use of the data item 46*n*, and is configured, in dependence on the strand guiding segment 10*n*, or the structural type thereof, in such a manner that a configuration 28*n* adapted to the structural type of the strand guiding segment 10*n* is loaded, or established.

Further, the segment-specific data item 46*p* is read out of the storage unit 48*p*, i.e. the RFID storage element 52, of the strand guiding segment 10*p* by use of the read unit 54, and transmitted to the control unit 22*p* via the field bus 26*a*. The control unit 22*p* identifies the strand guiding segment 10*p*, or the structural type thereof, by use of the data item 46*p*, and is configured, in dependence on the strand guiding segment 10*p*, or the structural type thereof, in such a manner that a configuration 28*p* adapted to the structural type of the strand guiding segment 10*n* is loaded, or established.

The segment-specific items of information 38*m* to 38*p* are transmitted to the main control unit 32*a*. The main control unit 32*a* has an operator interface 56, which has a configuration 58 in the form of a graphical user interface for illustrating operating data of the strand guiding system 8*a* and of the mounted strand guiding segment 10*a-r* that is prepared for adaptation to strand guiding segments of differing types and, by use of the segment-specific items of information 38*m* to 38*p*, is adapted to the strand guiding segments 10*m* to 10*p*.

In addition, a computer-assisted simulation model 60, on which the open-loop control or closed-loop control of the strand guiding system 8*a* is based, is executed on the main control unit 32*a*, or on a processor unit of the main control unit 32*a* that is not represented for reasons of simplicity, in particular for the purpose of calculating setpoint values for setting positions and/or setting forces of the strand guiding rollers 16, 20 (see FIG. 2). The simulation model has a configuration 62 in the form of model variables and/or simulation parameters which is prepared for adaptation to strand guiding segments of differing types and, by use of the segment-specific items of information 38*m* to 38*p*, is adapted to the strand guiding segments 10*m* to 10*p*.

Figure 4:
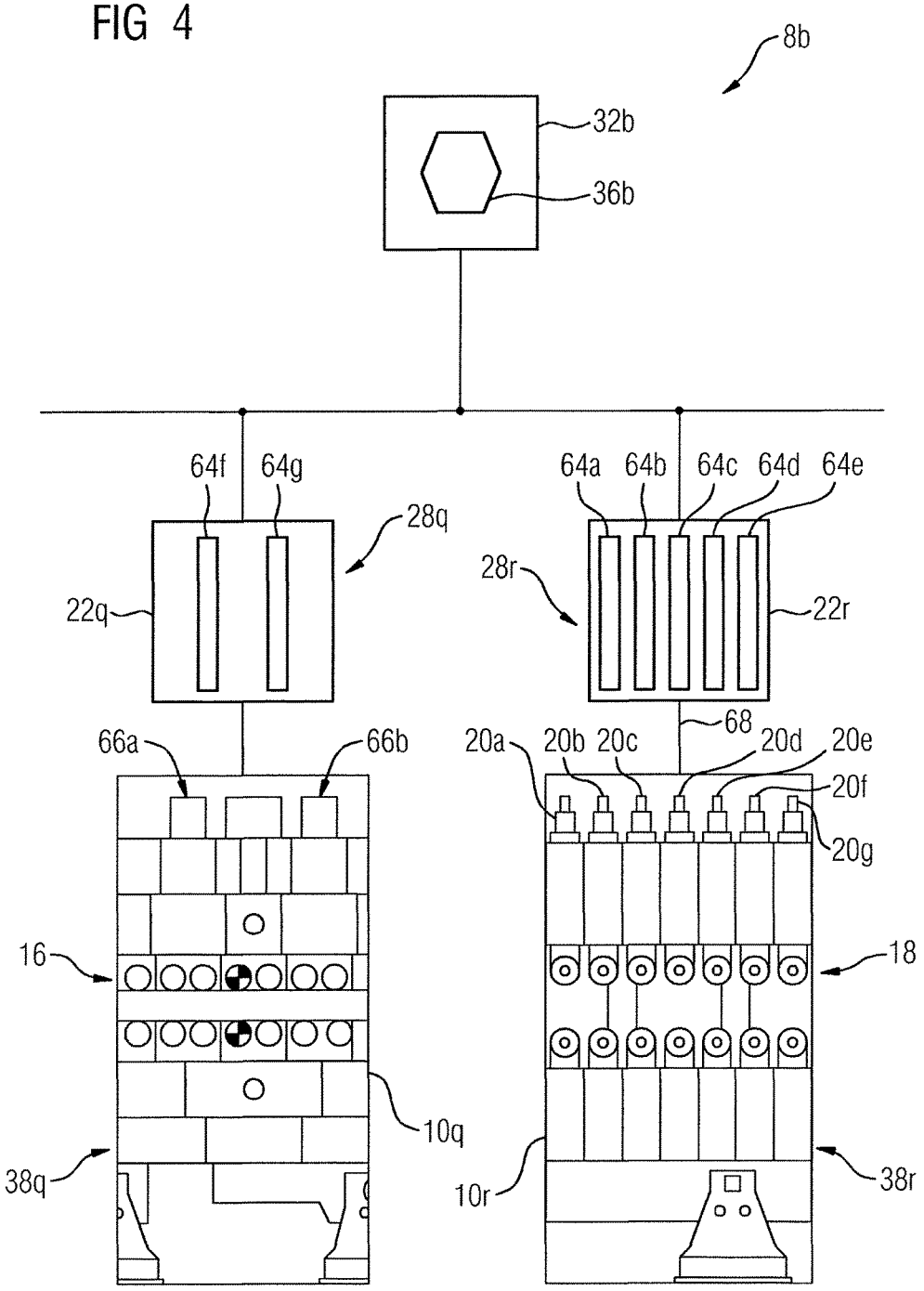
FIG. 4 is a schematic illustration of a further strand guiding system, with control units that each has a plurality of closed-loop control elements.

FIG. 4 shows a schematic illustration of a further strand guiding system 8*b*, having control units 22*q* and 22*r*, which are assigned to the strand guiding segment 10*q* and the strand guiding segment 10*r*, respectively, and which each have a plurality of closed-loop control elements 64*a-g*.

Each of the closed-loop control elements 64*a* to 64*g* is assigned, respectively, to at least one strand guiding roller 16 or 18 of the strand guiding segment 10*q* or 10*r* that is assigned to the respective control unit 22*q* or 22*r*, respectively, which strand guiding roller can be set against the strand.

In the present exemplary embodiment, the closed-loop control elements 64*a-g* are realized in software and in the present case are each a constituent part of the configurations 28*q* or 28*r*, respectively, of the control means 22*q* and 22*r*.

The closed-loop control elements 64*a-g* are prepared, by use of a known closed-loop control law, a setpoint value and an actual value of a controlled variable, to determine a manipulated value, or a closed-loop control signal, for influencing the controlled variable. Here, the controlled variable is, respectively, a setting position and/or a setting force of one or more of the settable strand guiding rollers 16 or 18 of the strand guiding segments 10*q* and 10*r*.

Each of the closed-loop control elements 64*a* to 64*e* of the control unit 22*r* is assigned to at least one of the roller units 20 (see also FIG. 2) of the strand guiding segment 10*r* and consequently at least to one of the individually settable strand guiding rollers 18.

More precisely, the closed-loop control element 64*a* is assigned to the roller unit 20*a*, the closed-loop control element 64*b* is assigned to the roller unit 20*b*, the closed-loop control element 64*c* is assigned to the roller unit 20*c*, the closed-loop control element 64*d* is assigned to the roller unit 20*d*, and the closed-loop control element 64*e* is assigned to the roller unit 20*e*, such that respectively one closed-loop control element is assigned to precisely one roller unit. In addition, the closed-loop control element 64*e* is assigned to the roller unit 20*f* and to the roller unit 20*g* i.e. to two of the roller units 20.

The roller units 20*a* to 20*g* are each constituted by a strand guiding roller 18 that can be set individually against the strand, and an adjustment means for setting this strand guiding roller. The roller units 20*a* to 20*g* are prepared for individual demounting from and/or mounting into the strand guiding segment 10*r*, and connected individually to the control unit 22*r* assigned to the strand guiding segment 10*r*, the connection in the present case being established via an aggregate cable 68 composed of a plurality of connecting cables.

The closed-loop control element 64*f* is assigned to a roller means 66*a*, and the closed-loop control element 64*g* is assigned to a roller means 66*b*, of the strand guiding segment 10*q*. The roller means 66*a* and 66*b* are each constituted by an adjustment means and by strand guiding rollers that can be set in multiples against the strand.

For the purpose of configuring the strand guiding system 8*b*, each of the control units 22*q* and 22*r* identifies the strand guiding segment 10*q* or 10*r* respectively assigned thereto, by use of the segment-specific item of information 38*q* or 38*r*, respectively (see FIG. 2). The control units 22*q* and 22*r* are each configured substantially automatically in such a manner that a necessary number of the software-based closed-loop control elements 64*a-g* is determined, according to the structural type of the identified strand guiding segment 10*q* or 10*r*, and the closed-loop control elements are assigned appropriately according to the structural type.

Figure 5:
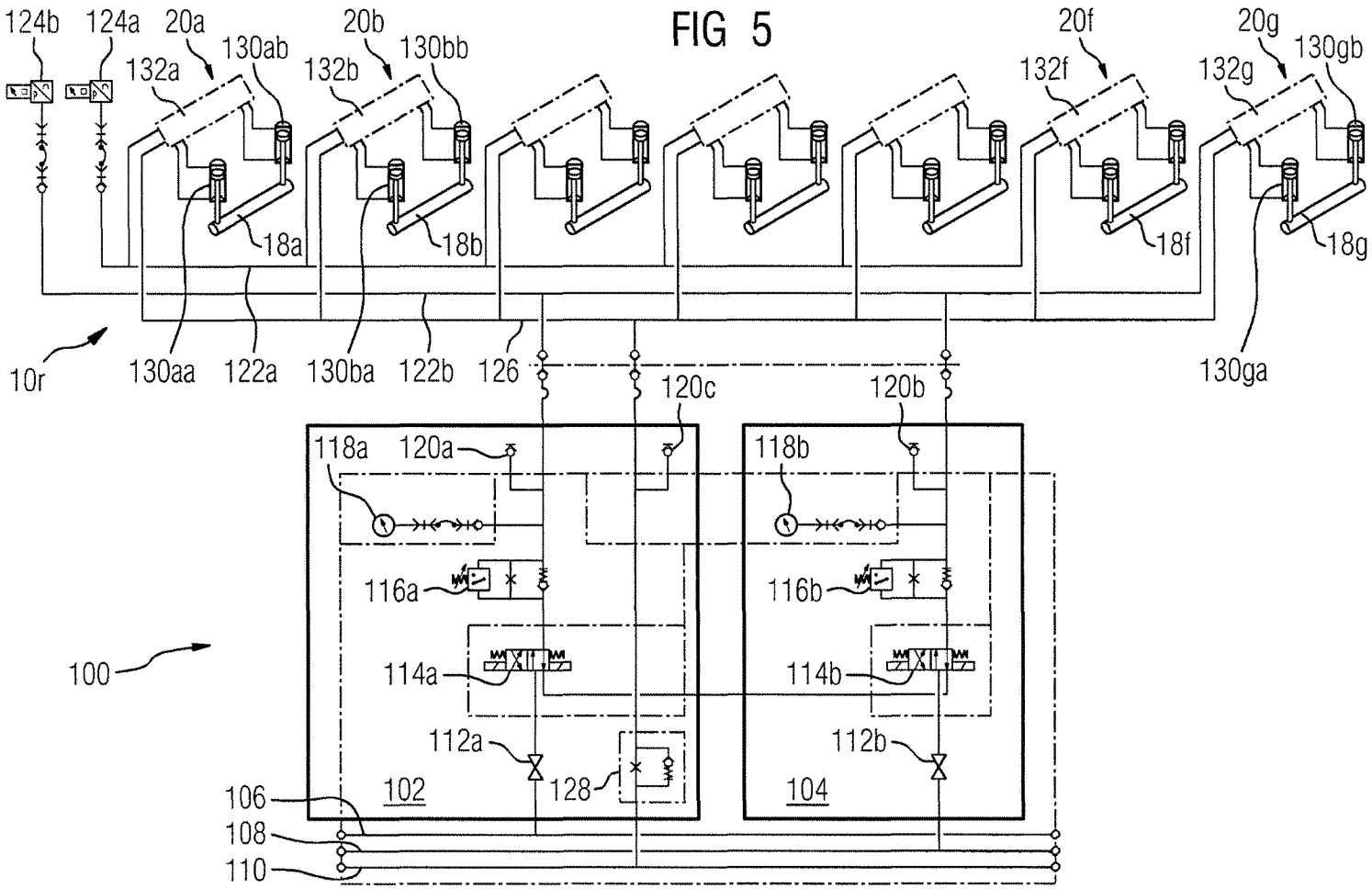
FIG. 5 shows a schematic representation of a hydraulic means for supplying power fluid to a strand guiding segment from FIG. 4.

FIG. 5 shows a schematic representation of a hydraulic means 100 for supplying power fluid to the strand guiding segment 10*r* from FIG. 4, the hydraulic means 100 being prepared to supply the individual roller units 20*a* to 20*g* of the strand guiding segment 10*r*.

The hydraulic means 100 has a first infeed means 102, which is assigned to the roller units 20*a* to 20*f* and indirectly connected to the latter, and a second infeed means 104, which is assigned to the roller unit 20*g* and indirectly connected to the latter.

In addition, the hydraulic means 100 has a first power fluid infeed line 106, which is connected to the first infeed means 102, and a second power fluid infeed line 108, which is connected to the second infeed means 104, and a power fluid discharge line 110.

The first infeed means 102 starting from the first power fluid infeed line 106 has a shut-off valve 112*a*, an electromagnetically controllable 3/2-way valve 114*a*, a hose rupture safety means 116*a*, a pressure gauge 118*a* and a non-return valve 120*a*, and is connected to a power fluid line 122*a* that is common to the roller units 20*a* to 20*f*.

The second infeed means 104 starting from the second power fluid infeed line 108 has a shut-off valve 112*b*, an electromagnetically controllable 3/2-way valve 114*b*, a hose rupture safety means 116*b*, a pressure gauge 118*b* and a non-return valve 120*b*, and is connected to a power fluid line 122*b* that is common to the roller unit 20*g*.

The power fluid lines 122*a* and 122*b* each have a pressure measuring means 124*a* and 124*b*, respectively.

The power fluid discharge line 110 is connected to a tank discharge line 126 that is common to the roller units 20*a* to 20*g*, and has a throttle valve 128 and a non-return valve 120*c*.

The individually settable strand guiding rollers 18*a* to 18*g* of the roller units 20*a* to 20*g* can each be set by means of two double-acting hydraulic cylinders 130*aa* and 130*ab* to 130*ga* and 130*gb*, and are each respectively supplied with power fluid and controlled via a hydraulic unit 132*a* to 132*g*.

The hydraulic units 132*a* to 132*f* are connected to the power fluid line 122*a*, and the hydraulic unit 132*g* is connected to the power fluid line 122*b*, all hydraulic units 132*a* to 132*g* being connected to the common tank line 126.

Figure 6:
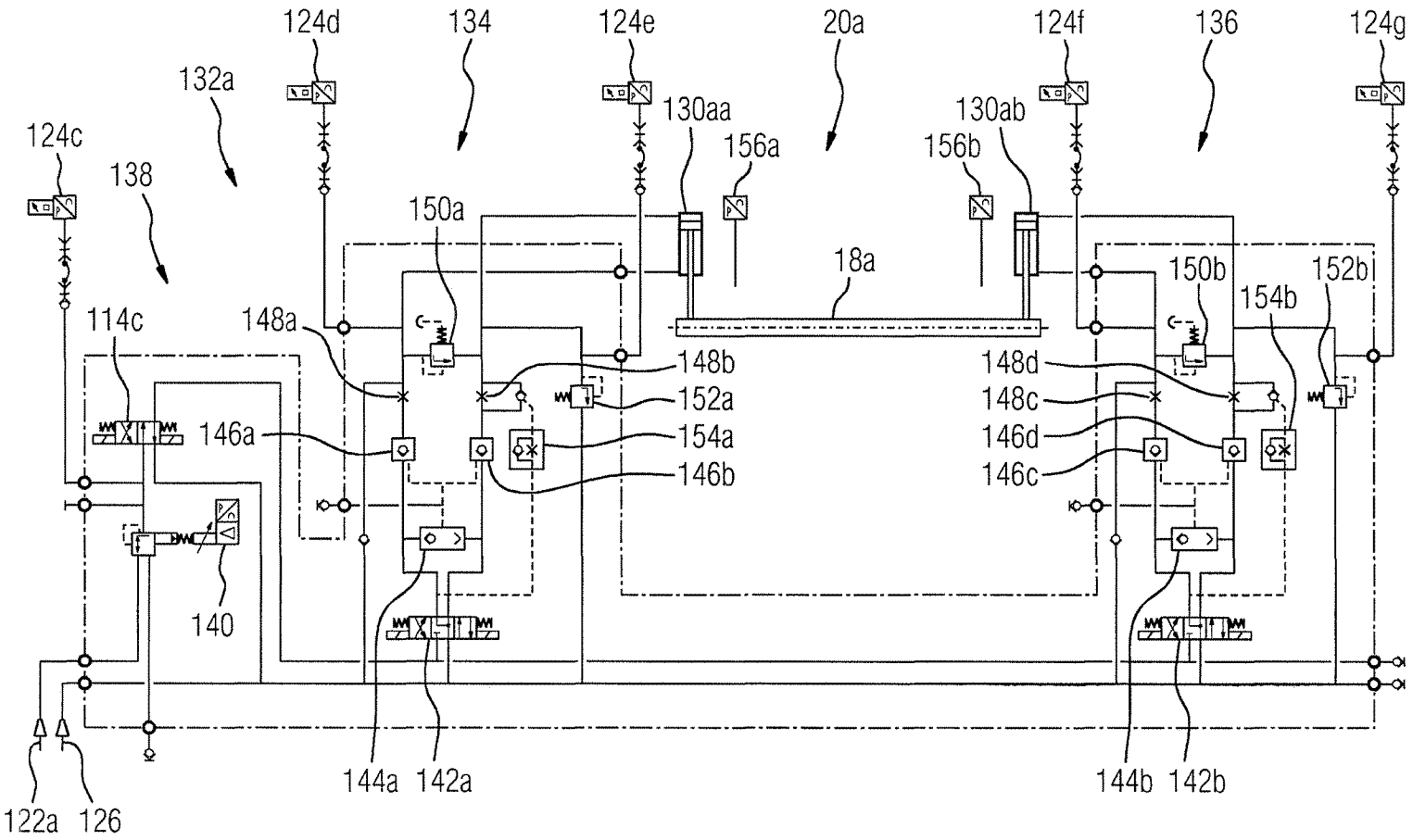
FIG. 6 shows a detailed schematic representation of a hydraulic unit from FIG. 5.

FIG. 6 shows a detailed schematic representation of the hydraulic unit 132*a*. FIG. 6 shows how the hydraulic cylinders 130*aa* and 130*ab* of the individually settable strand guiding roller 18*a* can be controlled by means of the hydraulic unit 132*a*, in particular in combination with the control unit 22*r* (see FIG. 4).

The hydraulic unit 132*a* is realized as a constituent part of the roller unit 20*a* and is mounted, for example, directly on the roller unit 20*a*, or on a frame thereof.

The hydraulic unit 132*a* has a first infeed unit 134, which is connected to the hydraulic cylinder 130*aa* for the purpose of driving the latter, and a second infeed unit 136, which is connected to the hydraulic cylinder 130*ab* for the purpose of driving the latter.

The infeed units 132 and 134 are connected indirectly to the power fluid line 122*a* for the purpose of supplying it with power fluid, via the hydraulic means 100 (see FIG. 5), and connected directly to the tank line 126, for the purpose of discharging power fluid.

A pressure regulating unit 138 is connected upstream from the infeed units 134 and 136, in the direction of the power fluid line 122*a*.

The pressure regulating unit 138 is connected directly to the power fluid line 122*a*, and has a pressure regulating valve 140, a 3/2-way valve 114*c* and a pressure measuring means 124*c*.

The infeed unit 134 has a 4/3-way valve 142*a* that has a floating mid-travel position. In the infeed direction, leading to the hydraulic cylinder 130*aa*, the infeed unit 134 has a shuttle valve 144*a* downstream from the 4/3-way valve 142*a*, two controllable non-return valves 146*a* and 146*b*, two diaphragm valves 148*a* and 148*b*, a settable pressure limiting valve 150*a*, two pressure measuring means 124*d* and 124*e*, a pressure limiting valve 152*a* and a non-return diaphragm valve 154*a*.

The infeed unit 136 has a 4/3-way valve 142*b* that has a floating mid-travel position. In the infeed direction, leading to the hydraulic cylinder 130*ab*, the infeed unit 136 has a shuttle valve 144*b* downstream from the 4/3-way valve 142*b*, two controllable non-return valves 146*c* and 146*d*, two diaphragm valves 148*c* and 148*d*, a settable pressure limiting valve 150*b*, two pressure measuring means 124*f* and 124*g*, a pressure limiting valve 152*b* and a non-return diaphragm valve 154*b*.

In addition, the roller unit 20*a* has two displacement measuring means 156*a* and 156*b*, which are each respectively assigned to one of the hydraulic cylinders 130*aa* and 130*ab*, and which are prepared to determine a setting position of the settable strand guiding roller 18*a*.

A closed-loop control of the setting position of the strand guiding roller 18*a* is effected, in particular, by use of the 4/3-way valves 142*a* and 142*b* assigned to the hydraulic cylinders 130*aa* and 130*ab*, and of the displacement measuring means 156*a* and 156*b*. By appropriate controlling of the 4/3-way valves 142*a* and 142*b* by the control unit 22*r* (see FIG. 4) by means of a control signal, the 4/3-way valves 142*a* and 142*b* are moved out of a mid-travel position, and a roller gap between the strand and the strand guiding roller 18*a* is opened or closed.

In particular, the 4/3-way valves 142*a* and 142*b* are controlled by the closed-loop control element 64*a* (see FIG. 4), which is assigned to the roller unit 20*a*, and which may be a 3-point controller or a higher-order controller, and the strand guiding roller 18*a* is thereby adjusted to a setpoint setting position or a setpoint setting force. The positioning closed-loop control may be effected independently of a setting force of the strand guiding roller 18*a*. A minimum and/or a maximum setting force may be ensured by the hydraulic unit 132*a*, the hydraulic means 100 and/or by a corresponding configuration of the control unit 22*r*.

Further, a setting force of the strand guiding roller 18*a* may be determined, by the determination of a respective pressure in the respectively two chambers of the hydraulic cylinders 130*aa* and 130*ab*, by means of the pressure measuring means 124*d* and 124*e*, and 124*f* and 124*g*, respectively.

The mid-travel position of the 4/3-way valves 142*a* and 142*b* is held by means of the non-return valves 146*a* to 146*d*. A travel speed of the strand guiding roller 18*a*, or of the hydraulic cylinders 130*aa* and 130*ab*, is limited by the diaphragm valves 148*a* to 148*d*.

A closed-loop control of a setting force of the strand guiding roller 18*a* is effected, in particular, by use of the pressure regulating valve 140 upstream from the 4/3-way valves 142*a* and 142*b* and the pressure measuring means 124*c*, the controllable non-return valves 146*a* to 146*d* also: holding valves being gradually opened via the shuttle valves 144*a* and 144*b*, respectively. The closed-loop control of the setting force may be effected independently of the setting position of the strand guiding roller 18*a*. Further, a minimum and/or a maximum setting position of the strand guiding roller 18*a* are/is ensured, thereby avoiding inadmissible variances between the hydraulic cylinders 130*aa* and 130*ab* and/or the roller units 20*a* to 20*g* of the strand guiding segment 10*r*.

Further, a closed-loop control of the setting position of the strand guiding roller 18*a* may be effected indirectly, or implicitly, by a closed-loop control of the setting force of the strand guiding roller 18*a*. In this case, the setting force is increased or reduced in dependence on a deviation from a setpoint value of the setting position that can be determined by means of the displacement measuring means 156*a* and 156*b*. This dependence, and consequently a rigidity, may be freely selectable within fixed limits, in particular by means of a corresponding configuration of the control unit 22*r*.

In addition, the setting force of the strand guiding roller 18*a* may be controlled indirectly, or implicitly, by means of a closed-loop control of the setting position, in which the setting position is controlled by closed-loop control in such a manner that an average setting force corresponds substantially to a predefined setpoint value of the setting force.

Preferably, the setting forces of the individually settable strand guiding rollers 18 of the roller units 20 are controlled by closed-loop control in a completely solidified region of the strand, i.e., for example, in the region of the strand guiding segments 10*j* to 10*l* of the strand guiding system 8 (see FIG. 1).

In addition, it is advantageous if the setting positions of the strand guiding rollers 16 or 18 of the strand guiding segments, or of the roller units, are controlled by closed-loop control in a partly solidified region of the strand, i.e., for example, in the region of the strand guiding segment 10*a* to 10*i* of the strand guiding system 8 (see FIG. 1).

In the case of a signal failure, for example resulting from a malfunction of the control unit 22*r*, the pressure regulating valve 140 establishes a balance between an outlet pressure and a supply pressure of a power fluid. In the case of a malfunction of the displacement measuring means 156*a* or 156*b*, the hydraulic cylinders 130*aa* and 130*ab* can be held in a position by a gradual shutting-off of the 4/3-way valves 142*a* and 142*b*, respectively, via the non-return valves 146*a* to 146*d*. In the event of a malfunction, for example, of the 4/3-way valves 142*a* and/or 142*b*, the strand guiding roller 18*a* can be held in a position by a gradual shutting-off of the 3/2-way valves 114*c*, via the non-return valves 146*a* to 146*d*.

LIST OF REFERENCES

2 continuous casting machine
4 ladle turret
6 mould
8, 8*a*, 8*b* strand guiding system
10*a*-10*r* strand guiding segment
12 steel girder
14 supporting structure
16 strand guiding rollers
18, 18*a*-18*g* individually settable strand guiding rollers
20, 20*a*-20*g* roller unit
22*g*-22*r* control unit
24*g*-24*l* open-loop control signal, closed-loop control signal
26, 26*a* field bus
28*g*-28*p* configuration
30 network connection
32, 32*a*, 32*b* main control unit
34*g*-34*l* setpoint value signal
36, 36*b* configuration
38*m*-38*r* segment-specific item of information
40 hardware coding
42 software coding
44*m*, 44*o* segment-specific plug connection
46*n*, 46*p* segment-specific data item
48*n*, 48*p* storage unit
50 RAM storage module
52 RFID storage element
54 read unit
56 operator interface
58 configuration
60 simulation model
62 configuration
64*a*-64*g* closed-loop control element
66, 66*b* roller means
68 aggregate cable
100 hydraulic means
102 infeed means
104 infeed means
106 power fluid infeed line
108 power fluid infeed line
110 power fluid discharge line
112*a*, 112*b* shut-off valve
114*a*-114*c* 3/2-way valve
116*a*, 116*b* hose rupture safety means
118*a*, 118*b* pressure gauge
120*a*-120*c* non-return valve
122*a*, 122*b* pressure fluid line
124*a*-124*g* pressure measuring means
126 tank line
128 throttle valve
130*aa*-130*gb* hydraulic cylinder
132*a*-132*g* hydraulic unit
134 infeed unit
136 infeed unit
138 pressure regulating unit
140 pressure regulating valve
142*a*, 142*b* 4/3-way valve
144*a*, 144*b* shuttle valve
146*a*-146*d* controllable non-return valve
148*a*-148*d* diaphragm valve
150*a*, 150*b* settable pressure limiting valve
152*a*, 152*b* pressure limiting valve
154*a*, 154*b* non-return diaphragm valve
156*a*, 156*b* displacement measuring means
L strand longitudinal direction

The invention claimed is:

1. A method for configuring a strand guiding system of a continuous casting machine, wherein the strand guiding system has a plurality of strand guiding segments and a plurality of control units, and respectively one control unit is assigned to each strand guiding segment, the method comprising:

causing each control unit to identify the respective strand guiding segment assigned thereto by using a segment-specific item of information, which is software and/or hardware coded; and configuring each control unit substantially automatically in dependence on the strand guiding segment identified by it, by at least one of setting operating parameters and by selection of a computer-readable program code, wherein the control units are at least one of logically and physically separate, and at least some of the control units that are substantially the same are assigned to strand guiding segments of differing structural types.

2. The method as claimed in claim 1, wherein the software coding comprises a data item, the method further comprising storing the data item in a storage unit of the strand guiding segment.

3. The method as claimed in claim 1, wherein the hardware coding comprises a strand segment-specific plug connection of the strand guiding segment.

4. The method as claimed in claim 1, further comprising assigning a main control unit to the control units substantially automatically in dependence on the identified strand guiding segments by at least one of setting of operating parameters and by selection of a computer-readable program code.

5. The method as claimed in claim 4, further comprising:

basing the strand guiding system on an open-loop control or a closed-loop control of the strand guiding system by determining open-loop or closed-loop control signals of the strand guiding system depending upon the identified strand guiding segments;

determining setpoint values for the open-loop control or the closed-loop control of at least one of setting positions of the strand guiding rollers and setting forces of the settable strand guide rollers;

determining the setting forces or the setting positions of the strand guide rollers by use of a simulation model comprised of a computer-readable program code on a processor unit of the main control unit; and using the respective determined setpoint value to determine a manipulated value for at least one of the setting positions and the setting forces and using the determined manipulated value by means of the open-loop or closed-loop control signals for influencing at least one of the setting positions and the setting forces of the settable strand guiding rollers.

6. The method as claimed in claim 5, wherein one of the closed-loop control elements is assigned to a strand guiding roller of a strand guiding segment assigned to one of the control units.

7. The method as claimed in claim 1, further comprising configuring the strand guiding system after at least one of demounting and mounting of a strand guiding segment from or into the strand guiding system.

8. A strand guiding system comprising:

a plurality of strand guiding segments, each strand guiding segment configured for guiding a respective metallic strand, each strand guiding segment has at least one of a software coding and a hardware coding for identification thereof, and a plurality of control units, wherein one of the control units is respectively assigned to each strand guiding segment and is configured for controlling the strand guiding segment by transmission of an open-loop or a closed-loop control signal;

the control units are configured for identification of the strand guiding segment respectively assigned thereto by use of at least one of the software coding and the hardware coding of the respective strand guiding segment; and each control unit has a configuration that is configured to be adapted substantially automatically, in dependence on the identified strand guiding segment, by at least one of setting of operating parameters and by selection of a computer-readable program code, wherein each strand guiding segment comprises a storage unit comprising at least one of an RFID storage element and a RAM storage module configured to store the software coding.

9. The strand guiding system as claimed in claim 8, wherein the hardware coding comprises a mechanical element of a segment-specific plug connection.

10. The strand guiding system as claimed in claim 8, wherein each control unit comprises a plurality of closed-loop control elements, wherein each closed-loop control element is respectively assigned to a strand guiding roller of the strand guiding segment assigned to the respective control unit, wherein the strand guiding roller is set individually against the strand.

11. The strand guiding system as claimed in claim 8, further comprising a main control unit assigned to the control units and connected to the control units via a network connection, wherein the main control unit controls the control units by transmission of a respective setpoint value signal for forming open-loop or closed-loop control signals.

12. The strand guiding system as claimed in claim 11, further comprising:

the main control unit is configured to identify the strand guiding segments indirectly assigned thereto; and has a configuration that is adapted substantially automatically, in dependence on the identified strand guiding segments, by at least one of setting of operating parameters and by selection of a computer-readable program code.

13. The strand guiding system of claim 8, further comprising a plurality of the control units which are substantially the same are assigned to strand guiding segments of differing structural types.

14. A strand guiding system comprising:

a plurality of strand guiding segments, each strand guiding segment configured to guide a respective metallic strand, each strand guiding segment has at least one of a software coding and a hardware coding for identification thereof, and a plurality of control units, wherein one of the control units is respectively assigned to each strand guiding segment and is configured to control the strand guiding segment by transmission of an open-loop or a closed-loop control signal;

the control units are configured to identify the strand guiding segment respectively assigned thereto by use of at least one of the software coding and the hardware coding of the respective strand guiding segment; and each control unit has a configuration that is configured to be adapted substantially automatically, in dependence on the identified strand guiding segment, by at least one of setting of operating parameters and by selection of a computer-readable program code, wherein each control unit comprises a plurality of closed-loop control elements, wherein each closed-loop control element is respectively assigned to a strand guiding roller of the strand guiding segment assigned to the respective control unit, and wherein the strand guiding roller is set individually against the strand.

15. A strand guiding system comprising:

a plurality of strand guiding segments, each strand guiding segment configured to guide a respective metallic strand, each strand guiding segment has at least one of a software coding and a hardware coding for identification thereof, and a plurality of control units, wherein one of the control units is respectively assigned to each strand guiding segment and is configured to control the strand guiding segment by transmission of an open-loop or a closed-loop control signal;

the control units are configured to identify the strand guiding segment respectively assigned thereto by use of at least one of the software coding and the hardware coding of the respective strand guiding segment;

each control unit has a configuration that is configured to be adapted substantially automatically, in dependence on the identified strand guiding segment, by at least one of setting of operating parameters and by selection of a computer-readable program code;

a main control unit assigned to the control units and connected to the control units via a network connection, wherein the main control unit controls the control units by transmission of a respective setpoint value signal for forming open-loop or closed-loop control signals, and the main control unit is configured to identify the strand guiding segments indirectly assigned thereto; and has a configuration that is adapted substantially automatically, in dependence on the identified strand guiding segments, by at least one of setting of operating parameters and by selection of a computer-readable program code.

16. A method for configuring a strand guiding system of a continuous casting machine, wherein the strand guiding system has a plurality of strand guiding segments and a plurality of control units, and respectively one control unit is assigned to each strand guiding segment, the method comprising:

causing each control unit to identify the respective strand guiding segment assigned thereto by using a segment-specific item of information, which is software and/or hardware coded; and configuring each control unit substantially automatically in dependence on the strand guiding segment identified by it, by at least one of setting operating parameters and by selection of a computer-readable program code, wherein the hardware coding comprises a strand segment-specific plug connection of the strand guiding segment.

17. A strand guiding system comprising:

a plurality of strand guiding segments, each strand guiding segment configured to guide a respective metallic strand, each strand guiding segment has at least one of a software coding and a hardware coding for identification thereof, and a plurality of control units, wherein one of the control units is respectively assigned to each strand guiding segment and is configured to control the strand guiding segment by transmission of an open-loop or a closed-loop control signal;

the control units are configured to identify the strand guiding segment respectively assigned thereto by use of at least one of the software coding and the hardware coding of the respective strand guiding segment; and each control unit has a configuration that is configured to be adapted substantially automatically, in dependence on the identified strand guiding segment, by at least one of setting of operating parameters and by selection of a computer-readable program code, wherein the hardware coding comprises a mechanical element of a segment-specific plug connection.

* * * * *